US010575099B2

(12) United States Patent
Akimoto et al.

(10) Patent No.: US 10,575,099 B2
(45) Date of Patent: Feb. 25, 2020

(54) SPEAKER

(71) Applicant: JVC KENWOOD Corporation, Yokohama-shi, Kanagawa (JP)

(72) Inventors: Benjamin Akimoto, Yokohama (JP); Kazuyuki Inagaki, Yokohama (JP)

(73) Assignee: JVCKENWOOD Corporation, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/033,089

(22) Filed: Jul. 11, 2018

(65) Prior Publication Data

US 2019/0020953 A1 Jan. 17, 2019

(30) Foreign Application Priority Data

Jul. 12, 2017 (JP) ..... 2017-136152

(51) Int. Cl.
*H04R 9/02* (2006.01)
*H04R 9/06* (2006.01)
*H04R 9/04* (2006.01)

(52) U.S. Cl.
CPC ..... *H04R 9/022* (2013.01); *H04R 9/025* (2013.01); *H04R 9/06* (2013.01); *H04R 9/046* (2013.01)

(58) Field of Classification Search
CPC ..... H04R 9/022; H04R 9/025; H04R 9/06; H04R 9/063; H04R 9/046; H04R 9/043; H04R 9/045; H04R 2400/07; H04R 2400/11; H04R 1/02
USPC ..... 381/397, 398, 400, 401, 409, 410, 412, 381/416
See application file for complete search history.

(56) References Cited

U.S. PATENT DOCUMENTS 9,653,832 B2 * 5/2017 Higashitani ..... H01R 13/2407
10,306,370 B2 * 5/2019 Hyde ..... H04R 9/063
2005/0271242 A1 12/2005 Kaiya
2007/0237351 A1 * 10/2007 Hyde ..... H04R 9/022 381/397
2011/0274308 A1 * 11/2011 Doh ..... H04R 9/06 381/398
2013/0039529 A1 * 2/2013 Kim ..... H04R 9/00 381/412
2017/0250118 A1 * 8/2017 Yotsuya ..... G01L 19/0654

FOREIGN PATENT DOCUMENTS

JP 2005-348389 A 12/2005

* cited by examiner

*Primary Examiner* — Binh Kien Tieu
(74) *Attorney, Agent, or Firm* — Procopio, Cory, Hargreaves & Savitch LLP

(57) ABSTRACT

A speaker includes a center pole, a voice coil, a diaphragm, and a turbulent flow generator. A center pole includes a through hole formed in the center pole in an axial direction. The voice coil is disposed around the center pole. A diaphragm includes a center cap that is disposed to face an opening of the through hole. A turbulent flow generator is disposed inside the through hole. The turbulent flow generator generates a turbulent flow inside the through hole.

5 Claims, 8 Drawing Sheets

SPEAKER

CROSS REFERENCE TO RELATED APPLICATION

This application is based upon and claims the benefit of priority from Japanese patent application No. 2017-136152, filed on Jul. 12, 2017, the disclosure of which is incorporated herein in its entirety by reference.

BACKGROUND

The present disclosure relates to a speaker for outputting a sound.

An electrodynamic speaker including a center pole, a voice coil provided around the center pole, and a diaphragm is known (see, for example, Japanese Unexamined Patent Application Publication No. 2005-348389). A through hole is formed in the center pole in the axial direction. Heat generated in the voice coil is dissipated to the air flowing through the through hole via the center pole.

SUMMARY

However, since the flow of the air inside the through hole cannot be controlled, the heat dissipation efficiency of the center pole is not good. It is therefore desired to further improve the heat dissipation efficiency of the center pole and eventually to improve the cooling efficiency of the voice coil.

An example aspect of the present disclosure is a speaker including:

a center pole including a through hole formed in an axial direction;

a voice coil disposed around the center pole;

a diaphragm comprising a center cap that is disposed to face an opening of the through hole; and a turbulent flow generator disposed inside the through hole configured to generate a turbulent flow inside the through hole.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

First Embodiment

Hereinafter, embodiments of the present disclosure will be described with reference to the drawings.

Figure 1:
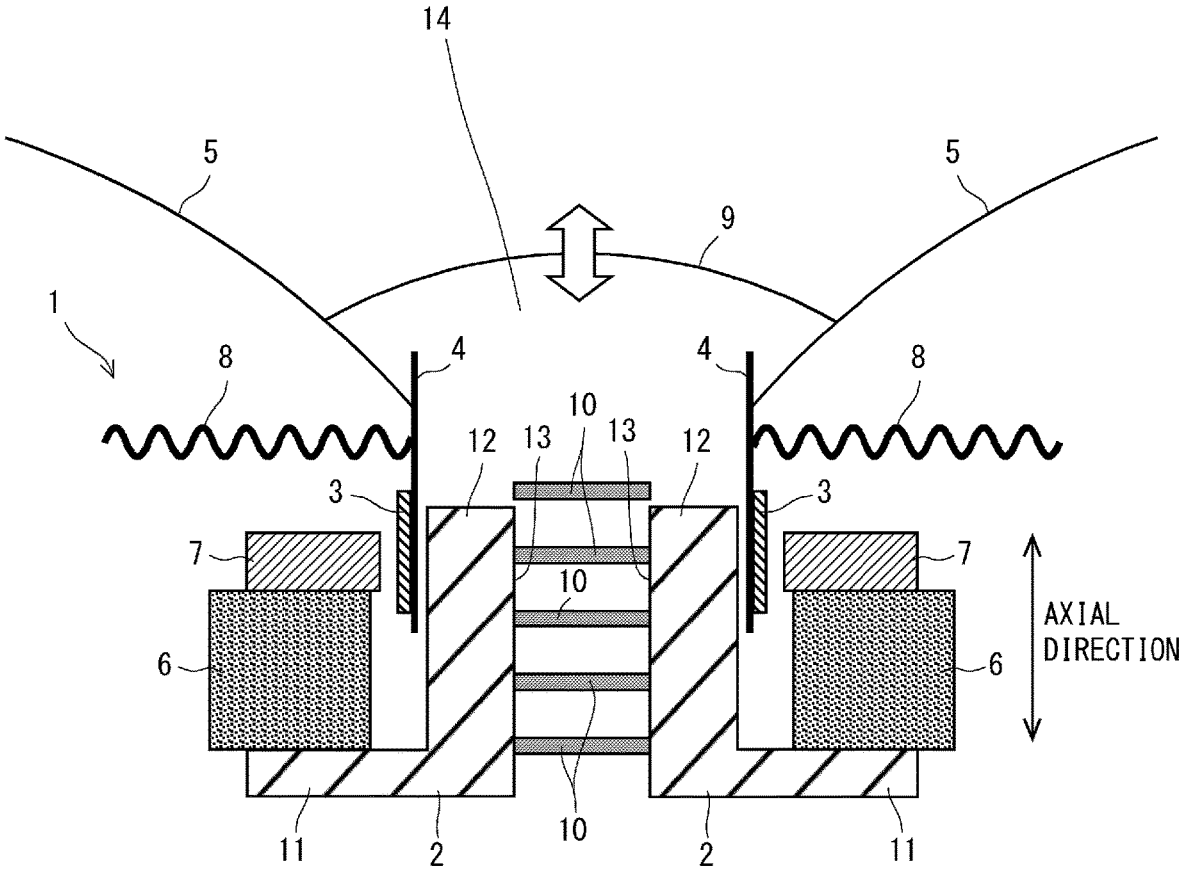
FIG. 1 is a view showing a schematic configuration of a speaker according to a first embodiment of the present disclosure.

FIG. 1 is a diagram showing a schematic configuration of a speaker according to a first embodiment of the present disclosure. The speaker 1 according to the first embodiment includes a yoke 2, a voice coil 3, a voice coil bobbin 4, a diaphragm 5, an annular magnet 6, an annular top plate 7, a damper 8, and a center cap 9.

The yoke 2 includes an annular bottom plate 11 and a tubular center pole 12 rising from a center of an upper surface of the bottom plate 11. The bottom plate 11 and the center pole 12 may be integrally molded. A through hole 13 is formed in the center pole 12 in the axial direction of the center pole 12.

A magnetic circuit of the speaker 1 is disposed and bonded coaxially with the yoke 2, the annular magnet 6, and the annular top plate 7 in this order. A lower surface and an upper surface of the annular magnet 6 are sandwiched and held between the upper surface of the bottom plate 11 of the yoke 2 and a lower surface of the top plate. The annular magnet 6 is magnetized in the axial direction. Magnetic lines of force generated by the annular magnet 6 are concentrated in a space sandwiched between an inner periphery of the annular top plate 7 and an outer periphery of the center pole 12, namely, in a magnetic gap, via the yoke 2 and the annular top plate 7.

The tubular voice coil bobbin 4 is disposed in the magnetic gap. The voice coil 3 is wound in layers around an outer periphery of the tubular voice coil bobbin 4.

The diaphragm 5 is formed in an opened truncated conical tubular shape, and a vertex side of the diaphragm 5 is bonded to an upper end part of the voice coil bobbin 4. A spherical shell-shaped center cap 9 is bonded to the central opening of the diaphragm 5. Like the diaphragm 5, an inner peripheral part of the damper 8 is bonded to the upper end side of the outer peripheral surface of the voice coil bobbin 4. Here, a back space 14 is defined by the voice coil bobbin 4, the diaphragm 5, the center cap 9, and the upper end of the center pole 12. The voice coil bobbin 4 may be omitted, and instead the voice coil 3 may be directly connected to the diaphragm 5.

Next, a method of operating the speaker 1 configured as described above will be described.

As the voice coil 3 is disposed in the magnetic gap in which the magnetic lines of force are concentrated, when a current flows through the voice coil 3, a driving force is generated in the vertical direction (the axial direction of the center pole 12) corresponding to the current. The voice coil bobbin 4 transmits the driving force generated in the voice coil 3 to the diaphragm 5 and the damper 8. The damper 8 damps the driving force transmitted from the voice coil bobbin 4. The diaphragm 5 and the center cap 9 vibrate according to the driving force transmitted from the voice coil bobbin 4 and output a sound.

The voice coil 3 is driven as described above and generates heat by itself (e.g., about 150 to 200° C.) due to electric resistance. The heat of the voice coil 3 could cause the voice coil 3 to melt, leading to a short-circuit or a disconnection in the voice coil 3. It is thus important to efficiently dissipate this heat. As will be described later, in the speaker 1 according to the first embodiment, the voice coil 3 can be efficiently cooled, and thus the reliability of the speaker can be improved.

The heat of the voice coil 3 is dissipated inside the through hole 13 via the voice coil bobbin 4 and the center pole 12 of the yoke 2. The diaphragm 5 and the center cap 9 vibrate by the driving force transmitted from the voice coil 3, and then a volume of the back space 14 is changed, thereby changing an air pressure in the back space 14 and generating an air flow inside the through hole 13 according to the air pressure. Then, the air inside the through hole 13, which has reached a high temperature, flows out to the outside of the through hole 13 when the air pressure in the back space 14 becomes a positive pressure. Conversely, when the air pressure in the back space 14 becomes a negative pressure, low temperature air flows into the through hole 13 from the outside of the yoke 2 of the through hole 12. In this way, the center pole 12 is cooled. The heat generated in the voice coil 3 is transmitted to the center pole, whereby the voice coil 3 is cooled.

Incidentally, as described above, when the voice coil 3 is cooled by utilizing the flow of the air inside the through hole 13 of the center pole 12, the heat dissipation efficiency of the center pole 12 becomes better and the cooling efficiency of the voice coil 3 improves if turbulent flows are actively generated in the flow of the air inside the through hole 13.

To this end, in the speaker 1 according to the first embodiment, a turbulent flow generator for generating turbulent flows inside the through hole 13 is disposed in the through hole 13 of the center pole 12 of the yoke 2.

The turbulent flow generator of the speaker 1 according to the first embodiment that generates turbulent flows over a wide range inside the through hole 13 can contribute to an improvement of the heat dissipation efficiency of the center pole 12 and the cooling efficiency of the voice coil 3.

The turbulent flow generator is composed of a turbulent flow generating member 10 that generates turbulent flows. The turbulent flow generating member 10 may be disposed at any position within the through hole 13. The turbulent flow generating member 10 disposed inside the through hole 13 causes turbulent flows to be generated in the flow of the air inside the through hole 13. This turbulent flow makes the air move in various directions to thereby let hot air on the radial outer side of the through hole 13 that is in contact with the center pole 12 exchange with cold air at the center of the through hole 13. Further, since the flow rate at the center of the through hole is greater than the flow rate in the vicinity of an inner wall of the through hole, heat of low-speed air on the radial outer side of the through hole 13 is transmitted to high-speed air at the center of the through-hole 13 to thereby efficiently transmit the heat of the center pole to the air inside the through-hole 13 by the turbulent flow. The hot air is discharged to the outside of the center pole 12 by the high-speed air at the center of the through hole that has received the heat from the inner wall of the through hole. This improves the heat dissipation efficiency of the voice coil 3. Further, the turbulent flow generator may be composed of a plurality of the turbulent flow generating members 10 inside the through hole 13.

Figure 2:
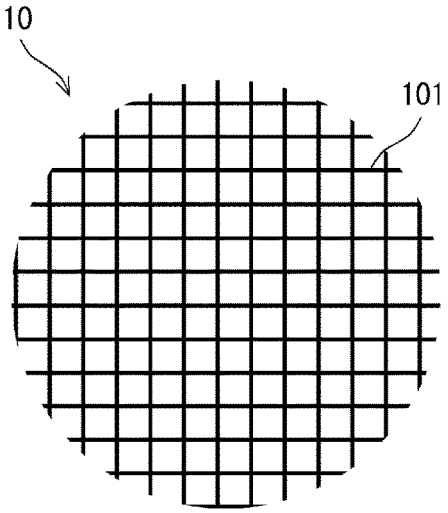
FIG. 2 is a view showing an example of a turbulent flow generator.

FIG. 2 is a view showing an example of the turbulent flow generator. The turbulent flow generator is composed of one or a plurality of turbulent flow generating members 10. For example, as shown in FIG. 2, the turbulent flow generating member 10 is a lattice mesh formed in a substantially circular shape corresponding to an inner diameter of the through hole 13 by combining turbulent flow generating members 101, which are wire rods, in a planar shape and entangling the turbulent flow generating members 10. However, the turbulent flow generating member 10 is not limited to this. The turbulent flow generating member may be any member as long as it plays a role of dividing at least a part of a cross section of the through hole 12 so as to cut across the flow of the air in the axial direction of the through hole 12. For example, the turbulent flow generating members 101 may be disposed in parallel or each one of the turbulent flow generating members 101 may be used as the turbulent flow generating member. Further, the turbulent flow generating member 101 may have a structure that increases the surface area. For example, the thickness may be changed along the line direction of the wire rod, which is the turbulent flow generating member 101, or fine hair may be provided on the surface of the turbulent flow generating member 101. The increased surface area improves the dissipation efficiency of the heat transmitted to the turbulent flow generating member from the center pole 12 and improves the cooling efficiency, because various magnitudes of turbulence flows can be generated.

For example, the turbulent flow generating member 10 may be a member obtained by three-dimensionally combining or entangling the turbulent flow generating members 101. With such a structure, the turbulent flow generating member 10 can generate more turbulent flows and further improve the heat dissipation efficiency.

The turbulent flow generating member 10 may be a thin protrusion protruding toward an inner diameter direction of the through hole 13. Alternatively, the turbulent flow generating member 10 may be a member composed of a plurality of protrusions radially disposed along an inner surface of the through hole 13. The turbulent flow generating member 101, which is a component of the turbulent flow generator, is preferably a metallic member such as aluminum or copper having high heat conductivity. By transferring the heat of the center pole 12 to the turbulent flow generator having thermal efficiency higher than that of the center pole 12, the heat can be efficiently dissipated to the air. This further improves the dissipation efficiency of the heat from the center pole 12.

The turbulent flow generator may be composed by disposing the turbulent flow generating member 10 only on the upper end inside the through hole 13. In this case, immediately after the air on the back of the cap flows into the through hole 13 from an opening at the upper end of the through hole 13, the air becomes a turbulent flow. However, the energy of the turbulent flow gradually decreases over time and gradually changes into a laminar flow from the point where the turbulent flow is generated toward the downstream of the flow. Thus cooling efficiency decreases. Therefore, as shown in FIG. 1, it is more preferable that the turbulent flow generator be composed of a plurality of turbulent flow generating members disposed in the axial direction of the through hole 13.

The plurality of turbulent flow generating members disposed in the axial direction of the through hole 13 can cause more turbulent flows to be generated in the direction of the flow of the air in the path. Therefore, it is possible to uniformly make the flow of the air inside the through hole 13 turbulent. That is, in the axial direction of the through hole 13, turbulent flows can be generated over a wide range on the radial outer side of the through hole 13, and the heat dissipation efficiency can be further improved.

The turbulent flow generating members 10 can be disposed at any position from the vicinity of the upper end to the vicinity of the lower end of the through hole 13. The turbulent flow generating members 10 may be disposed at any positions as long as they can generate turbulence flows over a wide range on the radial outer side of the through hole 13. For example, the turbulent flow generating members 10 may be disposed at equal intervals in the axial direction of the through hole 13 or may be disposed at different intervals.

Figure 3:
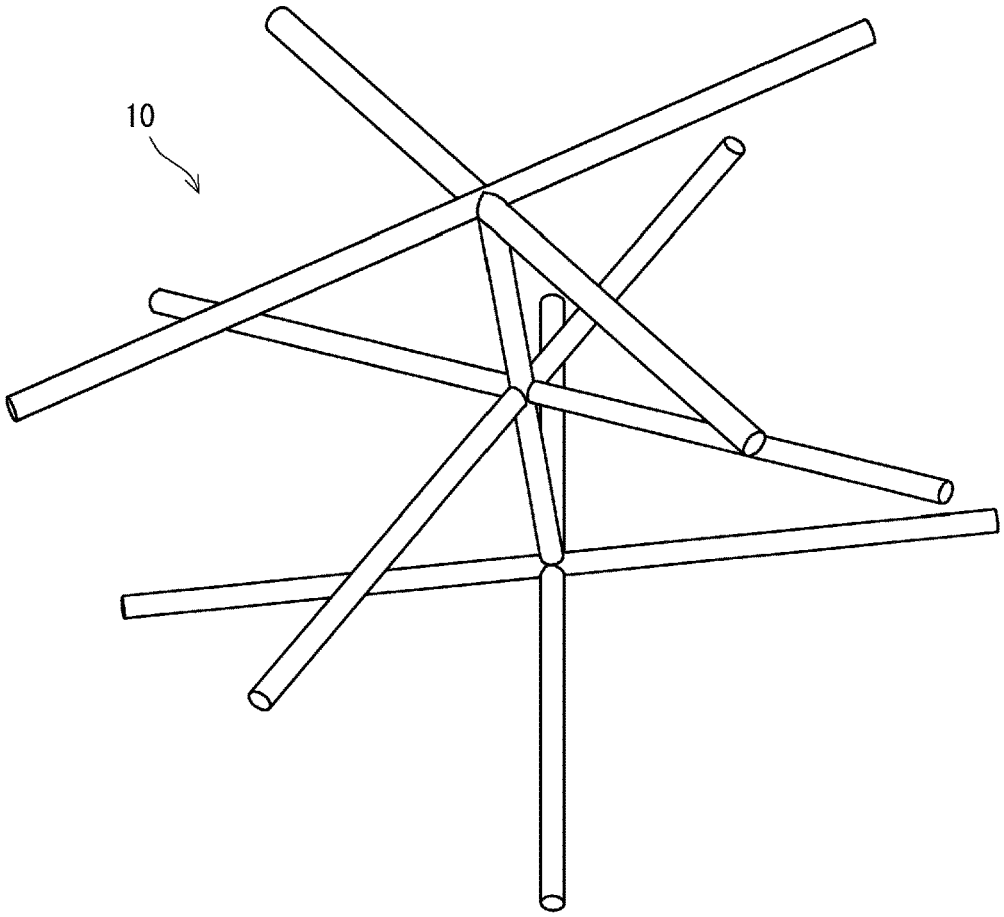
FIG. 3 is a view showing an example of turbulent flow generating members.

It is preferable that the respective turbulent flow generating members 10 be disposed in such a way that they do not overlap with each other as viewed from the axial direction of the through hole 13 of the center pole 12. The turbulent flow generating members 10 disposed in a non-overlapping manner can cut across the flow of the air more than the turbulent flow generating members 10 disposed in an overlapping manner. Such a case is shown in FIG. 3. In this manner, an area of the turbulent flow generating members 10 which the air hits as viewed from the axial direction of the through hole 13 increases, making it easy for turbulent flows to be easily generated. Another effect can be expected from such a structure of the turbulent flow generating members 10. Specifically, a turbulent flow generated by a certain turbulent flow generating member 10 hits another turbulent flow generating member 10, which does not overlap with the certain turbulent flow generating member 10 as viewed from the axial direction, and more turbulent flows can be generated as compared with the case where the turbulent flow generating members overlap in the axial direction. In this manner, more turbulent flows can be continuously generated, and thus the heat dissipation efficiency can be improved.

The air in the through hole randomly moves due to the turbulent flows, but the flow rates are uneven, such that there is a singularity where the flow rate is high, and a singularity where the flow rate is zero. When a singularity where the flow rate is zero occurs, the flow of the air does not occur, and the flow of air is blocked at the part of the singularity. Thus, there are scattered points with poor heat dissipation efficiency. For this reason, when the turbulent flow generating members 101 are disposed in such a way that they do not overlap with each other as viewed from the axial direction of the through hole 13 of the center pole 12 to compose the turbulent flow generating member 10, a pattern in which the turbulent flows are generated varies. Then, a different flow of the air affects the singularities in a constant turbulent flow generating pattern, and the singularities where the flow rates are zero scatter. That is, unevenness in the flow rates can be eliminated.

The air inside the through hole 13 reciprocates in the vertical direction along the axis because of the vertical vibration of the diaphragm 5. The turbulent flow generator 10 of the present disclosure can generate turbulent flows in the movement of air in any direction with respect to this reciprocating motion in the vertical direction.

For example, the turbulent flow generator may have a structure such that a pair of turbulent flow generating members 10 are respectively provided on the upper end side and the lower end side of the through hole 13, which makes the respective turbulent flow generating members 10 symmetrical. The turbulent generating part with such a structure can generate turbulent flows in both the upward and downward directions, thereby improving the heat dissipation efficiency.

When the speaker 1 is driven, the voice coil 3 always operates in the vertical direction along the axial direction of the center pole 12 of the yoke 2. Thus, a part of the center pole 12 where the heat is generated becomes an operation range of the voice coil 3.

Therefore, it is preferable that the turbulent flow generator be disposed within the range of a stroke (an amplitude) of the voice coil 3. The turbulent flow generator has a structure, for example, in which the plurality of turbulent flow generating members 10 are disposed within a range of a stroke in the vertical direction with reference to a vibration center of the voice coil 3. More turbulent flows can be generated in the vicinity of the inner wall of the center pole corresponding to the position of the voice coil 3, which reaches a higher temperature, and thus the heat dissipation efficiency can be improved.

Second Embodiment

As described above, when the turbulent flow generator is provided inside the through hole 13 of the center pole 12 of the yoke 2, the heat dissipation efficiency of the center pole 12 improves, and the cooling efficiency of the voice coil 3 improves. However, the movement of the air inside the through hole 13 is disturbed to thereby increase the air resistance, affecting the operation of the diaphragm 5.

Figure 4:
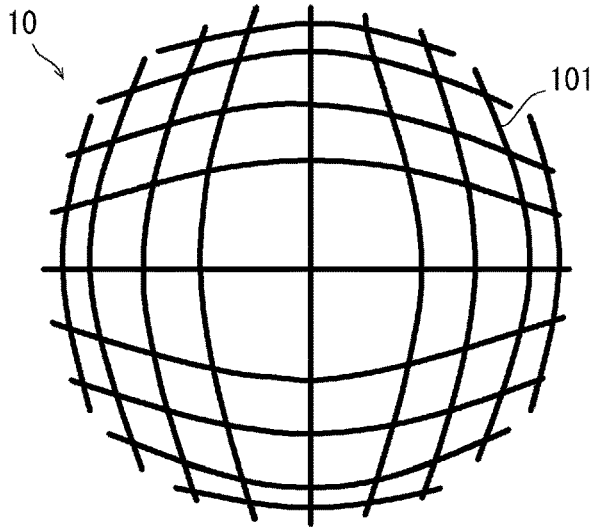
FIG. 4 is a view showing another example of the turbulent flow generator.

On the other hand, in a speaker 20 according to the second embodiment, the density in which the turbulent flow generating members 101 of the turbulent flow generating member 10 are combined is lower at the radial center of the through hole 13 than it is at the radial outer side of the through hole 13. As shown in FIG. 4, the lattice spacing of the turbulent flow generating members 101 of the turbulent flow generating member 10 is wider at the radial center of the through hole 13 than it is at the radial outer side of the through hole 13. In other words, the ratio of the areas where the turbulent flow generating members are present to spaces as viewed from the axial direction is high at the radial outer side of the through hole 13, whereas the ratio of the spaces to the areas where the turbulent flow generating members are present is high at the radial center of the through hole 13.

Consequently, fewer turbulent flows are generated at the radial center of the through hole 13, and the turbulent flows become like laminar flows. Hot air heated by the center pole 12 on the radial outer side of the through hole 13 is exchanged in the radial direction with cold air in the vicinity of the center of the through hole. The hot air that has moved to the center is promptly discharged to the outside of the through hole 13 by the laminar flows passing through the center of the through hole 13. The reduced density in which the turbulent flow generating members are combined at the center of the through hole 13 enables the hot air to be smoothly discharged, effectively prevents an increase in the air resistance, which affects the vibration of the diaphragm 5, and maintains high compliance. As described above, the high temperature air is exchanged with the low temperature air at the radially center of the through hole 13 by the turbulent flows on the high-temperature radial outer side of the through hole 13, thus enabling the heat of the center pole to be efficiently dissipated. That is, the speaker 20 of the second embodiment can achieve the effect of effectively eliminating an influence on the operation of the diaphragm 5 to thereby maintain high compliance and the effect of improving the cooling efficiency of the voice coil 3 by efficiently dissipating the heat and circulating the air heated by the center pole to thereby cool the center pole 12.

Figure 5:
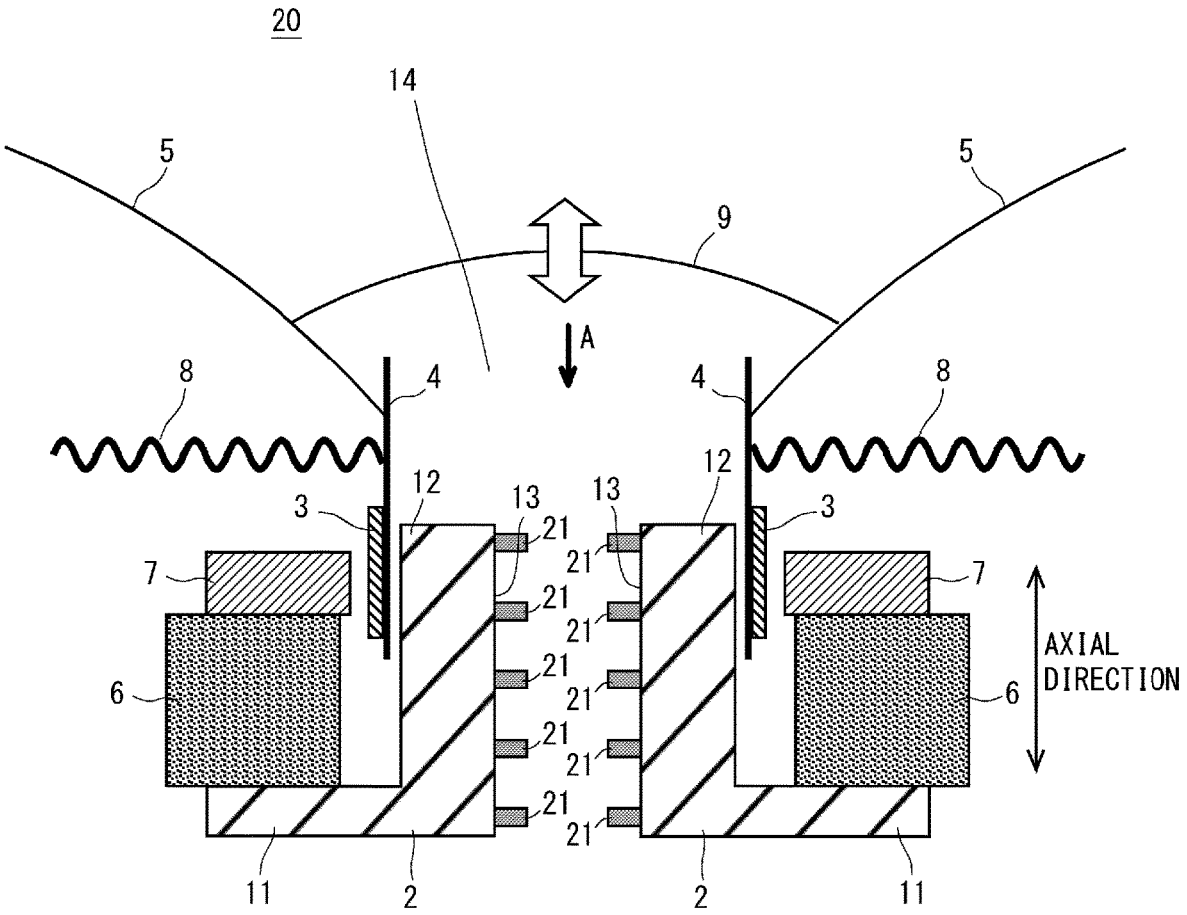
FIG. 5 is a view in which wire rods of the turbulent flow generator are disposed only in a radial outer peripheral part of a through hole of the center pole.
Figure 6:
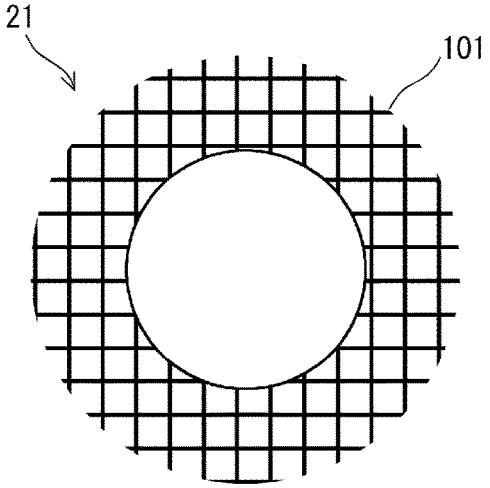
FIG. 6 is a view showing the turbulent flow generator shown in FIG. 5 as viewed from a direction A.

For example, as shown in FIG. 5, the turbulent flow generating members 21 may be disposed only on the radial outer side of the through hole 13 of the center pole 12. FIG. 6 is a view showing the turbulent flow generator shown in FIG. 5 as viewed from the direction A. The turbulent flow generating members 21 may be disposed, for example, only in the vicinity of the inner wall of the center pole 12 to constitute the turbulent flow generator 10. With such a structure, turbulent flows are generated in the vicinity of the inner wall of the center pole 12 to promptly cool the heat of the center pole 12, hence the heat of the voice coil 3, and thus the flow of the air becomes like a laminar flow at the center of the through hole 13. This achieves an effect of promptly discharging the heat of the center pole 12 and reducing the air resistance that affects the vibration of the diaphragm 5.

Since there is no structure generating a turbulent flow at the radial center of the through hole 13, no or a reduced number of turbulent flows are generated at the radial center of the through hole 13. Consequently, the air, which has been heated to a high temperature by the heat transmitted from the center pole 12 by the turbulent flows generated by the turbulent flow generating members disposed on the radial outer side of the through hole, passes through the radial center of the through hole 13 where no or a few turbulent flows are generated, and then is promptly discharged to the outside of the through hole 13. This effectively prevents the air resistance, which affects the vibration of the diaphragm 5, from increasing. Thus, the heat generated by the voice coil is released to the outside of the speaker magnetic circuit, achieving effective heat dissipation.

Figure 7:
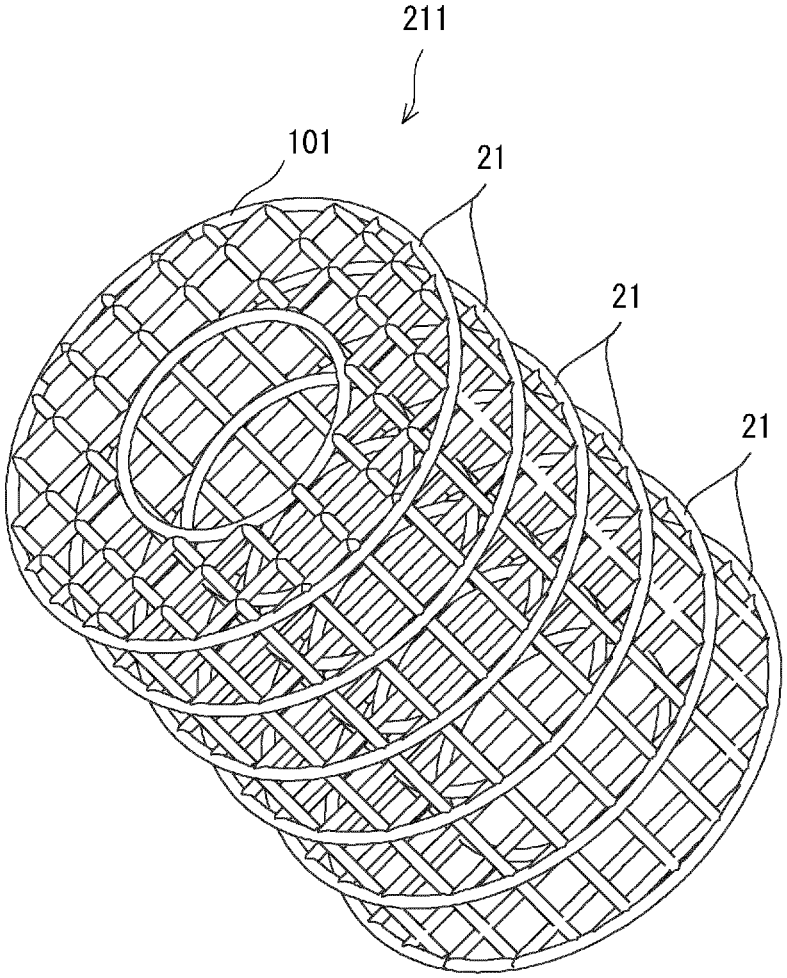
FIG. 7 is a perspective view showing a columnar member integrally composed of a plurality of the turbulent flow generators.
Figure 8:
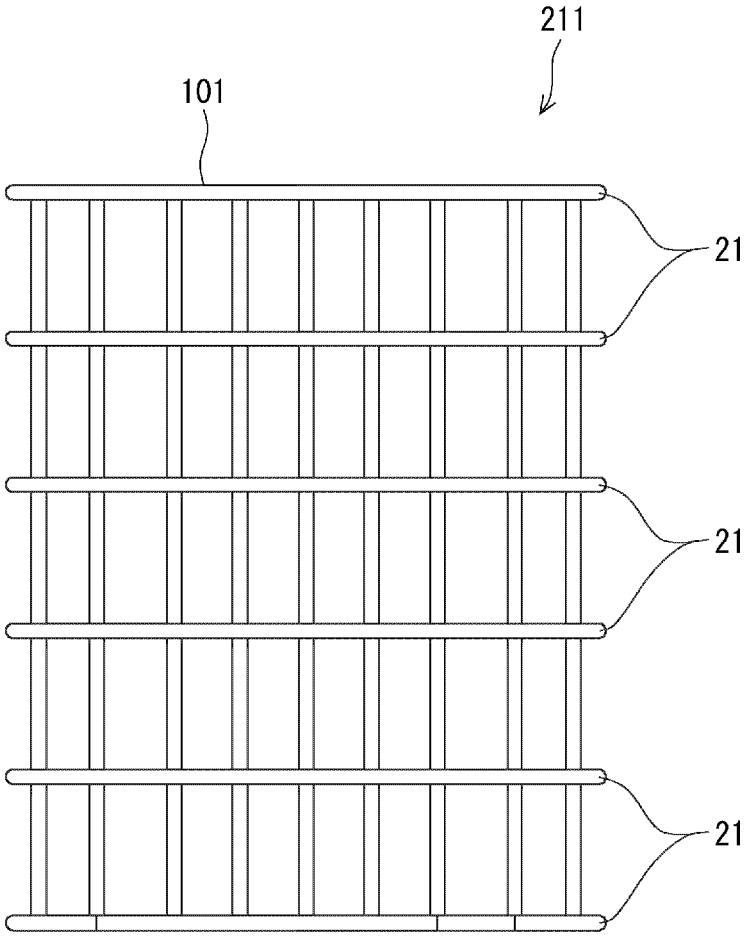
FIG. 8 is a side view showing the columnar member shown in FIG. 7 as viewed from the side.

FIG. 7 is a perspective view showing a columnar member integrally constituted by the turbulent flow generating members 21 composed of the plurality of turbulent flow generating members 101. FIG. 8 is a side view showing the columnar member shown in FIG. 7 as viewed from the side. For example, as shown in FIGS. 7 and 8, in a columnar member 211, the plurality of turbulent flow generating members 21 may be integrally connected. Each turbulent flow generating member 21 is formed as an annular lattice mesh. The columnar member 211 is inserted into the through hole 13 and disposed as a turbulent flow generator. The respective turbulent flow generating members 21 are connected to each other side by side in the axial direction of the through hole 13.

The lattice spacing of the lattice mesh of the turbulent flow generating member 21 of the columnar member 211 can be set highly accurately according to the flow rate of the air generated inside the through hole 13 by the vibration of the diaphragm 5 and the center cap 9. Therefore, turbulent flows can be more efficiently generated inside the through hole 13, and efficient heat dissipation becomes possible. Further, since it is only necessary to insert the columnar member 211 into the through hole 13, the turbulent flow generator can be easily formed inside the through hole 13, which leads to an improvement in productivity of the speaker. When the lattice spacing is reduced to generate more turbulent flows, a difference in the flow rate in the axial direction between that of the radial center of the through hole and that of the radial outer side of the through hole becomes large, and thus the slow air on the radial outer side of the through hole 13 is more actively exchanged with the fast air at the center of the through hole 13.

In the second embodiment, the same components as those in the first embodiment are denoted by the same reference signs, and a detailed description thereof are omitted.

Third Embodiment

Figure 9:
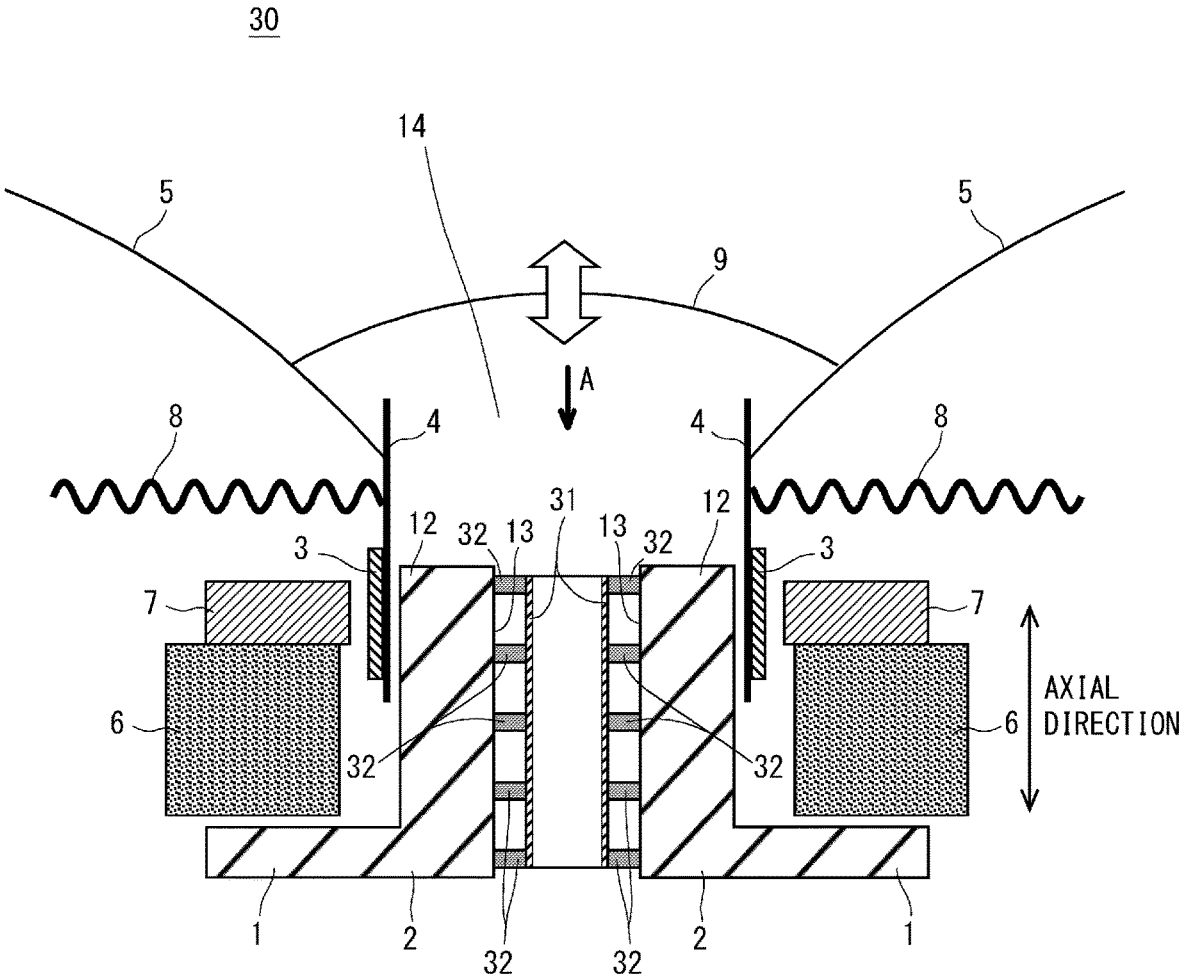
FIG. 9 is a view showing a schematic configuration of a speaker according to a third embodiment of the present disclosure.
Figure 10:
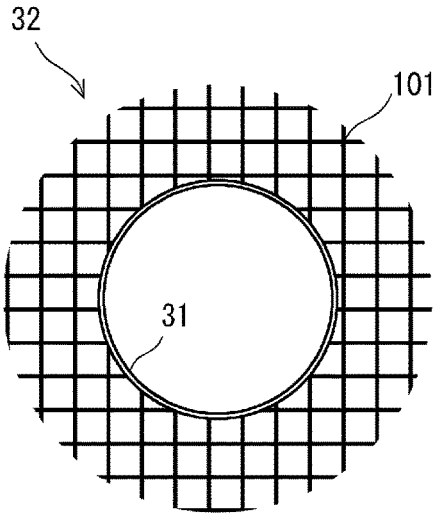
FIG. 10 is a view showing a tubular member shown in FIG. 9 as viewed from a direction A.

FIG. 9 is a view showing a schematic configuration of a speaker according to a third embodiment of the present disclosure. In a speaker 30 according to the third embodiment, as shown in FIG. 9, inside the through hole 13 of the center pole 12 of the yoke 2, a tubular member 31 is disposed along the axial direction of the through hole 13. FIG. 10 is a view showing the tubular member shown in FIG. 9 as viewed from direction A. The turbulent flow generating members 32 are disposed between an outer peripheral surface of the tubular member 31 and an inner peripheral surface of the center pole 12. The tubular member 31 has, for example, substantially the same entire length as that of the through hole 13.

The tubular member 31 disposed at the center of the through hole 13 makes the flow of the air inside the tubular member 31 become laminar flows, thereby reducing the air resistance when the diaphragm vibrates. Since the air inside the tubular member 31 is promptly discharged to the outside, the influence on the vibration of the diaphragm 5 can be further reduced, and the compliance is improved. On the other hand, the turbulent flow generating members 32 are disposed between the outer peripheral surface of the tubular member 31 and the inner peripheral surface of the center pole 12. Thus, the flow rate is increased because of the flow path narrower than that of the first and second embodiments, and the flow of the air between the outer peripheral surface of the tubular member 31 and the inner peripheral surface of the center pole 12 becomes a high-speed turbulent flow in the axial direction, which efficiently cools the center pole 12 that has reached a high temperature by the voice coil 3.

An outer periphery of the tubular member 31 may have, for example, a triangular cross section. Further, the tubular member 31 may have a specified shape, for example, a shape with a different diameter at a specified position in the axial direction as long as the compliance is not deteriorated. The length and shape of the tubular member 31 in the entire length direction is not limited, and may be any length and shape. Although the tubular member 31 is formed of a single tube, it is not limited to this. The tubular member 31 may be composed of, for example, double or more tubes.

When the outer periphery of the tubular member 31 is brought into contact with an inner surface of the center pole 12, the tubular member 31 is preferably made of a material having high heat conductivity such as aluminum. Thus, a part of the heat of the center pole 12 is dissipated to the low temperature air inside the tubular member 31 via the tubular member 31. Therefore, the heat of the center pole 12 can be dissipated more efficiently.

It is preferable that the tubular member 31 and the turbulent flow generating members 32 be integrally molded. This reduces the cost of the mold, man-hours required for parts management, and man-hours required for manufacturing, and thus the speaker 30 can be manufactured at a lower cost.

The tubular member 31 may be fixed inside the through hole 13 with the turbulent flow generating members 32 interposed therebetween. This eliminates the need for a fixing component for fixing the tubular member 31, and thus the manufacturing cost can be reduced. The heat of the center pole 12 is transmitted to the tubular member 31 via the turbulent flow generating members 32. Then, the heat of the center pole 12 can be efficiently dissipated by the tubular member 31. In this case, it is preferable that the tubular member 31 be made of a material having high heat conductivity such as aluminum or copper. In order not to reduce the diameter of the through hole, the outer tube does not need to be provided.

Figure 11:
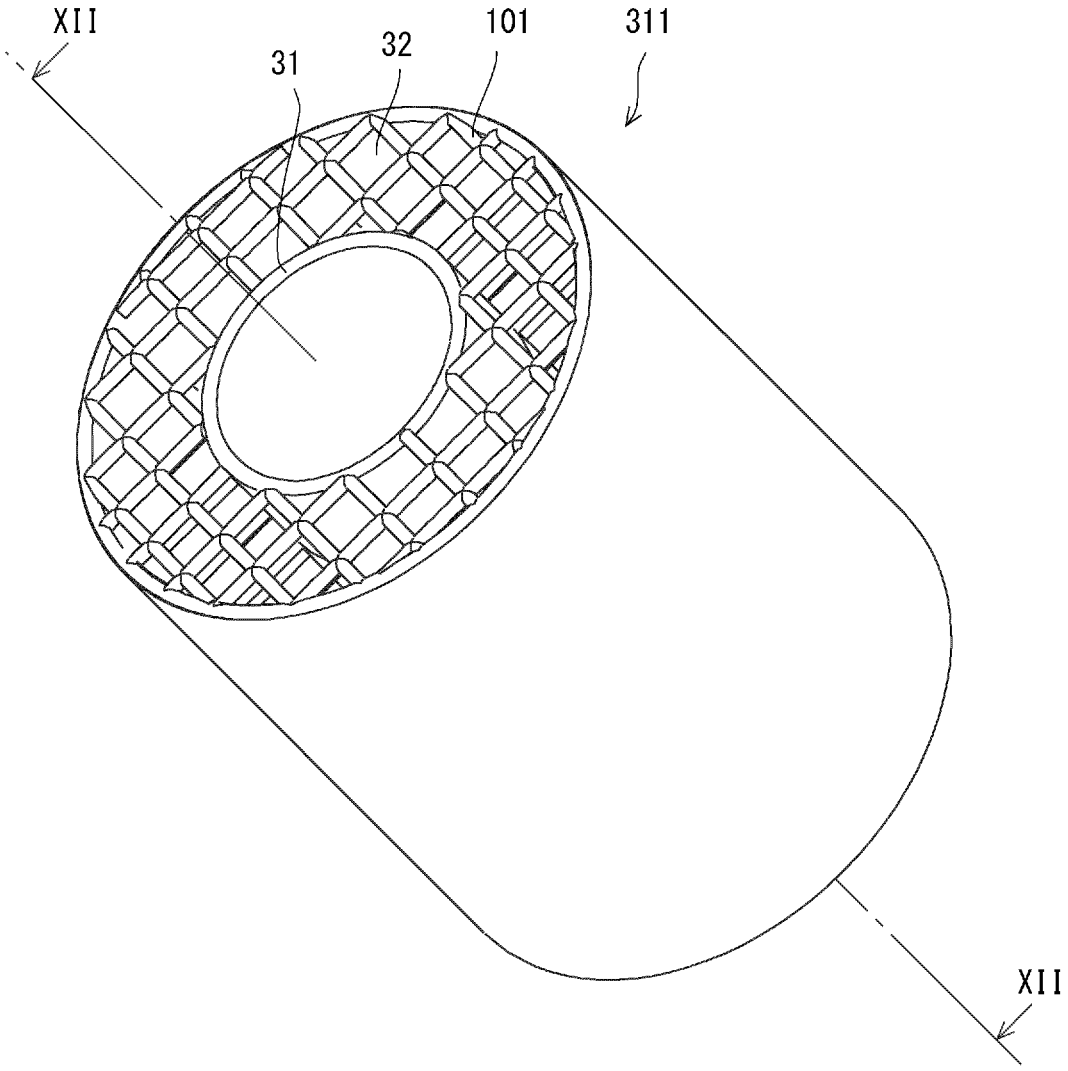
FIG. 11 is a perspective view showing a columnar member integrally composed of a plurality of turbulent flow generators and a tubular member.
Figure 12:
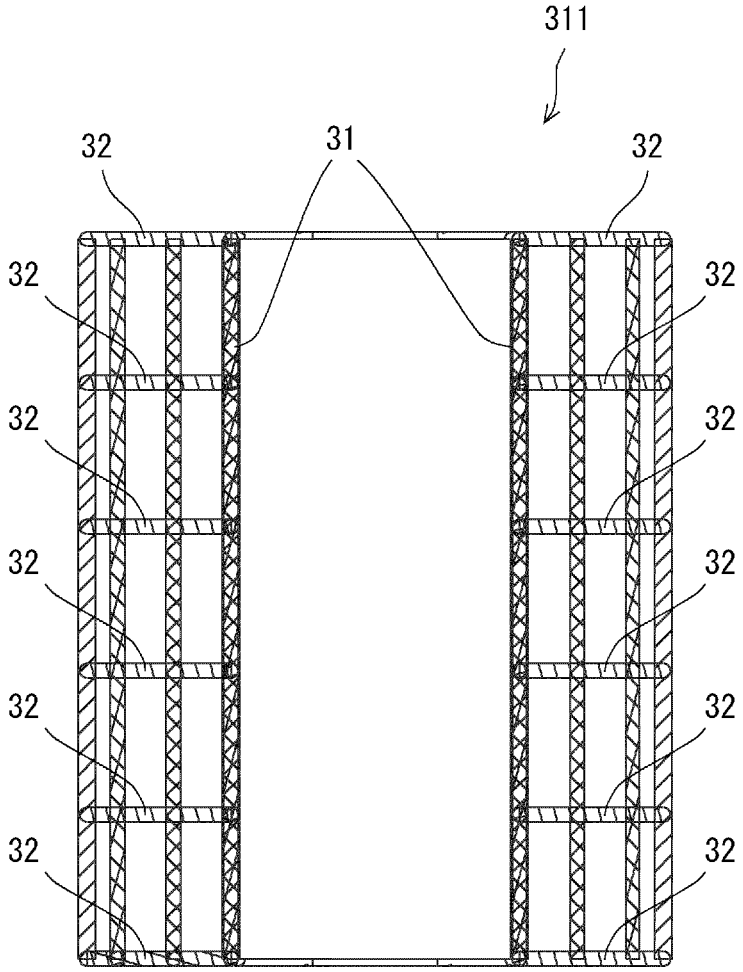
FIG. 12 is a cross-sectional view when the columnar member shown in FIG. 11 is cut along a plane passing through a line XII-XII.

FIG. 11 is a perspective view showing a tubular member integrally constituted by a plurality of turbulent flow generating members and a columnar member. FIG. 12 is a cross-sectional view when the columnar member shown in FIG. 11 is cut along a plane passing through a line XII-XII. For example, as shown in FIGS. 11 and 12, in a columnar member 311, the tubular member 31 and a plurality of turbulent flow generating members 32 are integrally connected. Each turbulent flow generating member 32 is formed as an annular lattice mesh. The columnar member 311 is inserted into the through hole 13. The respective turbulent flow generating members 32 are connected to each other side by side in the axial direction of the through hole 13. An inner peripheral part of each turbulent flow generating member 32 is connected to the outer peripheral part of the tubular member 31. In FIG. 11, the outer peripheral part of the columnar member 311 is tubular and has a shape that makes it easy for the heat of the center pole 12 to be conducted to the turbulent flow generating members 32.

When an outer periphery of the columnar member 311 is brought into contact with an inner surface of the center pole 12, the tubular member 31 is preferably made of a material having high heat conductivity such as aluminum. Thus, a part of the heat of the center pole 12 is dissipated to the low temperature air inside the columnar member 311 via the columnar member 311. Therefore, the heat of the center pole 12 can be dissipated more efficiently.

The spacing between the turbulent flow generating members 32 can be set while accurately setting the lattice spacing of the lattice mesh of the turbulent flow generating member 32 of the columnar member 311 according to the flow rate of the air generated inside the through hole 13 by the vibration of the diaphragm 5 and the center cap 9. Therefore, turbulent flows can be efficiently generated by the through hole 13, enabling effective heat dissipation. Further, since it is only necessary to insert the columnar member 311 into the through hole 13, the turbulent flow generator can be easily formed inside the through hole 13, which leads to an improvement in productivity of the speaker.

One or more vent holes for ventilating the air inside the tubular member 31 to the outside may be formed side by side in the axial direction of the tubular member 31. A part of the low-speed and high-temperature air between the inner periphery of the through hole 13 and the outer periphery of the tubular member 31 flows inside the tubular member 31 via the vent hole(s), and is discharged to outside the tubular member 31 together with the high-speed and low-temperature air inside the tubular member 31. Then, the heat of the center pole 12 can be efficiently dissipated.

In the third embodiment, a tube outside the columnar member 311 may not be provided. An extra space for the thickness of the eliminated tube on the outer periphery can contribute to an improvement in the compliance. Further, as turbulent flows directly hit the inner wall of the center pole 12, it is expected to produce an effect of more efficient heat transfer.

In the third embodiment, the same components as those in the first and second embodiments are denoted by the same reference signs, and a detailed description thereof are omitted.

The present disclosure is not limited to the above-described embodiments, and can be appropriately changed without departing from the spirit of the disclosure. For example, the configurations of the embodiments may be combined in any way.

In the speaker of the present disclosure, the diaphragm 5 and the center cap 9 may be integrally formed.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A speaker comprising:

a center pole comprising a through hole formed in an axial direction;

a voice coil disposed around the center pole;

a diaphragm comprising a center cap that is disposed to face an opening of the through hole; and a turbulent flow generator disposed inside the through hole and configured to generate a turbulent flow inside the through hole, wherein the turbulent flow generator is composed of at least one turbulent flow generating member disposed to cross the axial direction of the through hole, the at least one turbulent flow generating member is composed of a plurality of wire rods combined in a planar shape, and a density in which the plurality of wire rods that compose the at least one turbulent flow generating member are combined is lower at a center of the through hole than at a radial outer side of the through hole.

2. The speaker according to claim 1, wherein the turbulent flow generator is disposed in such a way that a plurality of turbulent flow generating members do not overlap with each other as viewed from the axial direction.

3. The speaker according to claim 1, wherein the turbulent flow generating member is composed of a plurality of three-dimensionally combined wire rods.

4. The speaker according to claim 1, wherein the turbulent flow generator is disposed along an inner wall surface of the center pole and there is no structure at the radial center of the through hole.

5. The speaker according to claim 1, wherein the turbulent flow generator is formed by entangling a plurality of turbulent flow generating members, the plurality of turbulent flow generating members are formed by combining wire rods in a planar shape.

* * * * *